US006095826A

United States Patent [19]

Potters

[11] Patent Number: 6,095,826

[45] **Date of Patent: *Aug. 1, 2000**

[54] PRESS FIT CIRCUIT BOARD CONNECTOR

[75] Inventor: Paul Johannes Marinus Potters, Eindhoven, Netherlands

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/804,717

[22] Filed: Feb. 21, 1997

[51] Int. Cl.[7] ..... H01R 12/00

[52] U.S. Cl. ..... 439/79

[58] Field of Search ..... 439/79, 80, 608, 439/595, 733.1, 108

[56] References Cited

U.S. PATENT DOCUMENTS

| | | | |
|---|---|---|---|
| 3,966,290 | 6/1976 | Little | 439/74 |
| 4,550,962 | 11/1985 | Czeschka | 339/17 LC |
| 4,684,203 | 8/1987 | Bihler | 439/885 |
| 4,699,595 | 10/1987 | Nakazawa | 439/676 |
| 4,749,373 | 6/1988 | Brekoskey et al. | 439/595 |
| 4,955,819 | 9/1990 | Harting et al. | 439/79 |
| 5,032,085 | 7/1991 | Alwine et al. | 430/79 |
| 5,037,334 | 8/1991 | Viselli et al. | 439/733 |
| 5,080,596 | 1/1992 | Viselli et al. | 439/79 |
| 5,141,453 | 8/1992 | Fusselman et al. | 439/608 |
| 5,151,036 | 9/1992 | Fusselman et al. | 439/108 |
| 5,261,829 | 11/1993 | Fusselmanet al. | 439/608 |
| 5,273,443 | 12/1993 | Frantz et al. | 439/595 |
| 5,277,621 | 1/1994 | Seto | 439/493 |
| 5,277,624 | 1/1994 | Champion et al. | 439/607 |
| 5,354,207 | 10/1994 | Chikano | 439/79 |
| 5,453,016 | 9/1995 | Clark et al. | 439/79 |
| 5,462,456 | 10/1995 | Howell | 439/733.1 |
| 5,490,787 | 2/1996 | Bowman et al. | 439/69 |
| 5,516,301 | 5/1996 | Kawakita | 439/733.1 |
| 5,564,949 | 10/1996 | Wellinsky | 439/608 |
| 5,593,307 | 1/1997 | Bale et al. | 439/567 |
| 5,593,311 | 1/1997 | Lubrand | 439/608 |
| 5,632,629 | 5/1997 | Legrady | 439/885 |
| 5,643,009 | 7/1997 | Dinkel et al. | 439/595 |

FOREIGN PATENT DOCUMENTS

| | | | |
|---|---|---|---|
| 0 569 782 | 11/1993 | European Pat. Off. . | |
| 0 563 942 | 12/1993 | European Pat. Off. . | |
| 0 649 195 | 4/1995 | European Pat. Off. . | |
| 0 729 203 | 8/1996 | European Pat. Off. . | |
| 1 582 222 | 9/1969 | France . | |
| 2 711 452 | 4/1995 | France | H01R 9/09 |
| 41 19 202 | 12/1991 | Germany . | |
| 94 17 390 U | 12/1994 | Germany . | |
| 2 095 485 | 9/1982 | United Kingdom . | |
| 2137027 | 9/1984 | United Kingdom | 434/595 |
| WO 93 08619 | 4/1993 | WIPO . | |
| WO 96/31922 | 10/1996 | WIPO | 16/648 |

OTHER PUBLICATIONS

European Search Report Dated Jul. 12, 1999 for Application Number EP 98 10 2427.

*Primary Examiner*—Gary F. Paumen
*Assistant Examiner*—Tho D. Ta
*Attorney, Agent, or Firm*—Brian J. Hamilla; M. Richard Page

[57] ABSTRACT

A right angle press fit connector employs a modular construction having a common terminal carrying press block that is associable with different types of shroud structures. The press block may include true positioned location structures for press fit tails. The true position structures may be integral with the press block. A cruciform shaped terminal insertion passage in the press block minimizes damage to the plating of the terminals and provides structural stiffness.

18 Claims, 14 Drawing Sheets

PRESS FIT CIRCUIT BOARD CONNECTOR

BACKGROUND OF THE INVENTION

1. Field of the Invention

This invention relates to electrical connectors, especially to high density printed circuit board connectors. It particularly relates to right angle connectors that are secured onto the printed circuit board by press fitting.

2. Brief Description of Prior Developments

High density, press fit printed circuit board connectors as illustrated in U.S. Pat. No. 5,044,994 have been commercialized. The right angle header connector illustrated in this patent employs a single piece construction in which the pin terminals are secured in a one piece molded plastic housing. The housing comprises a pin retention body and forwardly extending top and bottom walls that form a shroud enclosing two sides of the pin field. As industry requirements for increased signal speed and improved isolation from electromagnetic interference (EMI) have evolved, the desirability for providing electrical shielding for these headers has increased. This need for enhanced electrical performance has occurred in the context of continuous pressure to maintain or reduce the production costs for such connectors.

PCT Application U.S. 96/04670 shows one approach for improving electrical performance of a vertical, high density pin header in which the connector body is formed as a one piece metal housing. The pin terminals of the connector are secured in a molded plastic insulative holder having sleeves surrounding the base of the pins to insulate the pins from the connector body. In this connector, the terminal tails are straight and are not bent as required for a right angle header.

Another factor that influences the overall cost of using such connectors is the ease and reliability of mounting them. This requirement is made difficult by the necessity of assuring that the press fit tails of the terminals of 30, 40, or more terminals, usually on a 2 mm×2 mm pitch, must be located according to very tight true position tolerances, so that the tails are not mispositioned during board mounting. Tight true positions tolerances are particularly difficult to achieve when the terminals are formed of a relatively thick, stiff material and/or when the vertical tails of the terminals are relatively long. In order to achieve such positioning, tail positioning wafers as shown in the above-identified U.S. Pat. No. 5,044,994 have been utilized. In another approach as illustrated in U.S. Pat. No. 5,593,307, a separate press block with tail bending features has been proposed. However, the need for providing true position tail location at low manufacturing costs is not fully satisfied by these approaches, because they either add additional cost or do not provide sufficient tail location.

SUMMARY OF THE INVENTION

This invention relates to a connector that employs an insulative carrier for holding terminal pins of a connector. Alternative insulative or conductive shroud sections can be associated with the carrier to form non-shielded or shielded headers, respectively.

The invention also relates to assuring true position location of press fit terminal tails. In this aspect of the invention, the terminal holding structure is provided with position stops to be engaged by terminal tails under pretension to assure longitudinal positioning. Lateral positioning direction is imparted by at least one side wall of a slot in which the tail is located.

BRIEF DESCRIPTION OF THE DRAWINGS

FIG. 2 is a side cross-sectional view of the connector shown in

FIG. 1 taken along line A—A of FIG. 1;

DETAILED DESCRIPTION OF THE PREFERRED EMBODIMENTS

Figure 1:
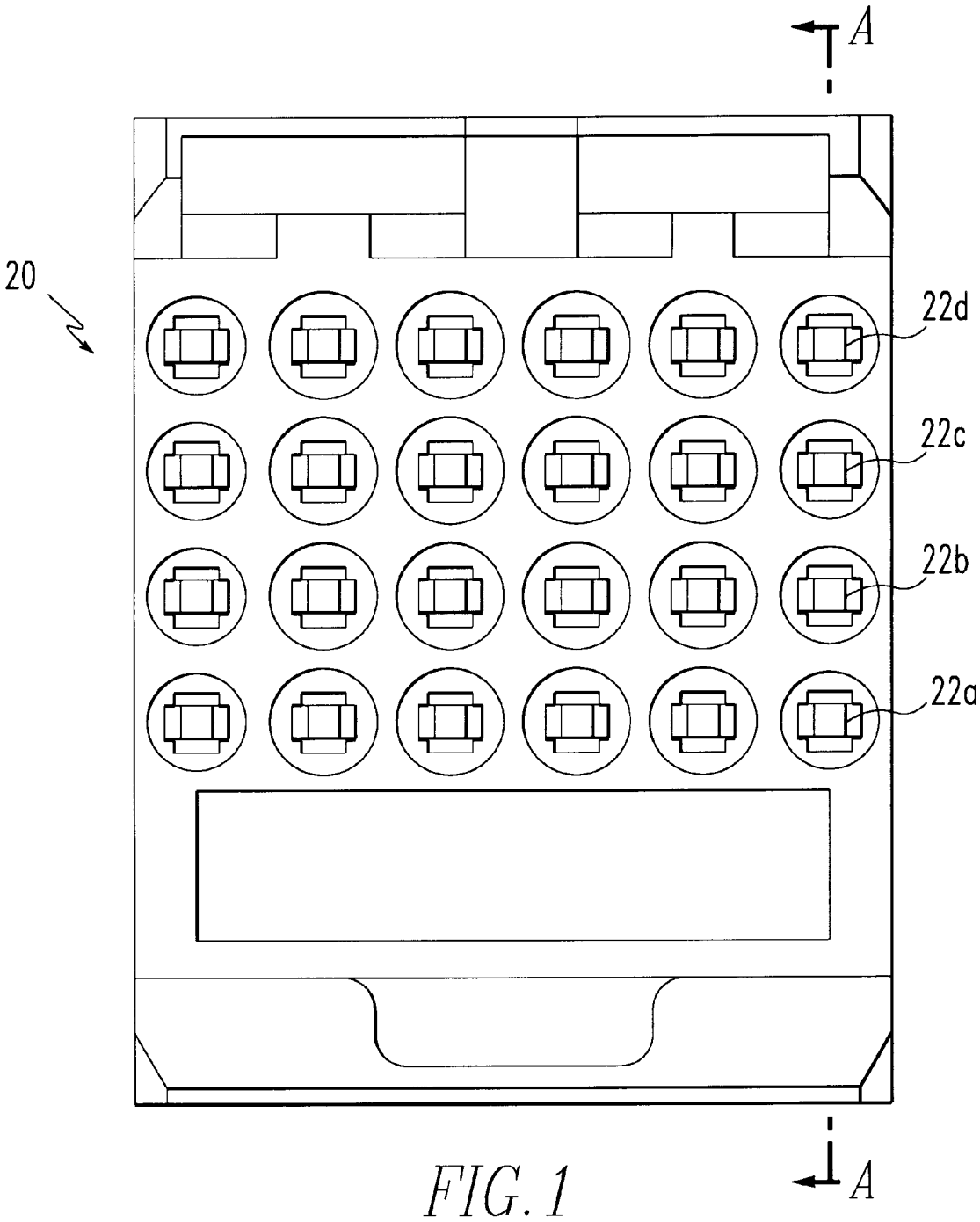
FIG. 1 is a front elevational view of a pin header according to a first embodiment of the invention.

As shown in FIG. 1, a first embodiment of pin header 20 has, as is conventional, an array of pins 22*a*–22*d* arranged in rows and columns. For illustrative purposes only (as other configurations are also used), the header is shown in FIG. 1 as having four rows (rows A–D) and six columns of pin terminals.

Figure 2:
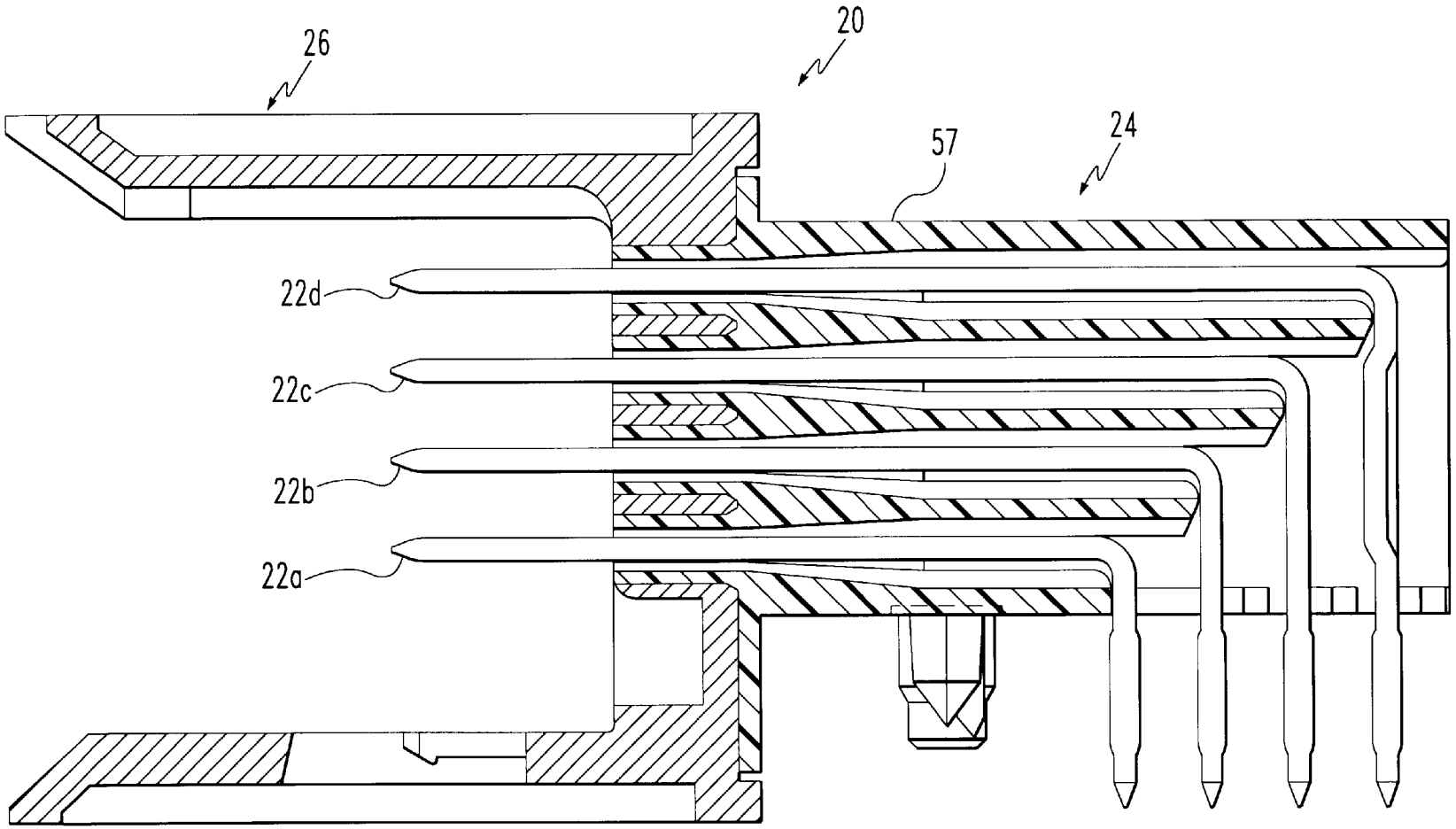
Figure 3:
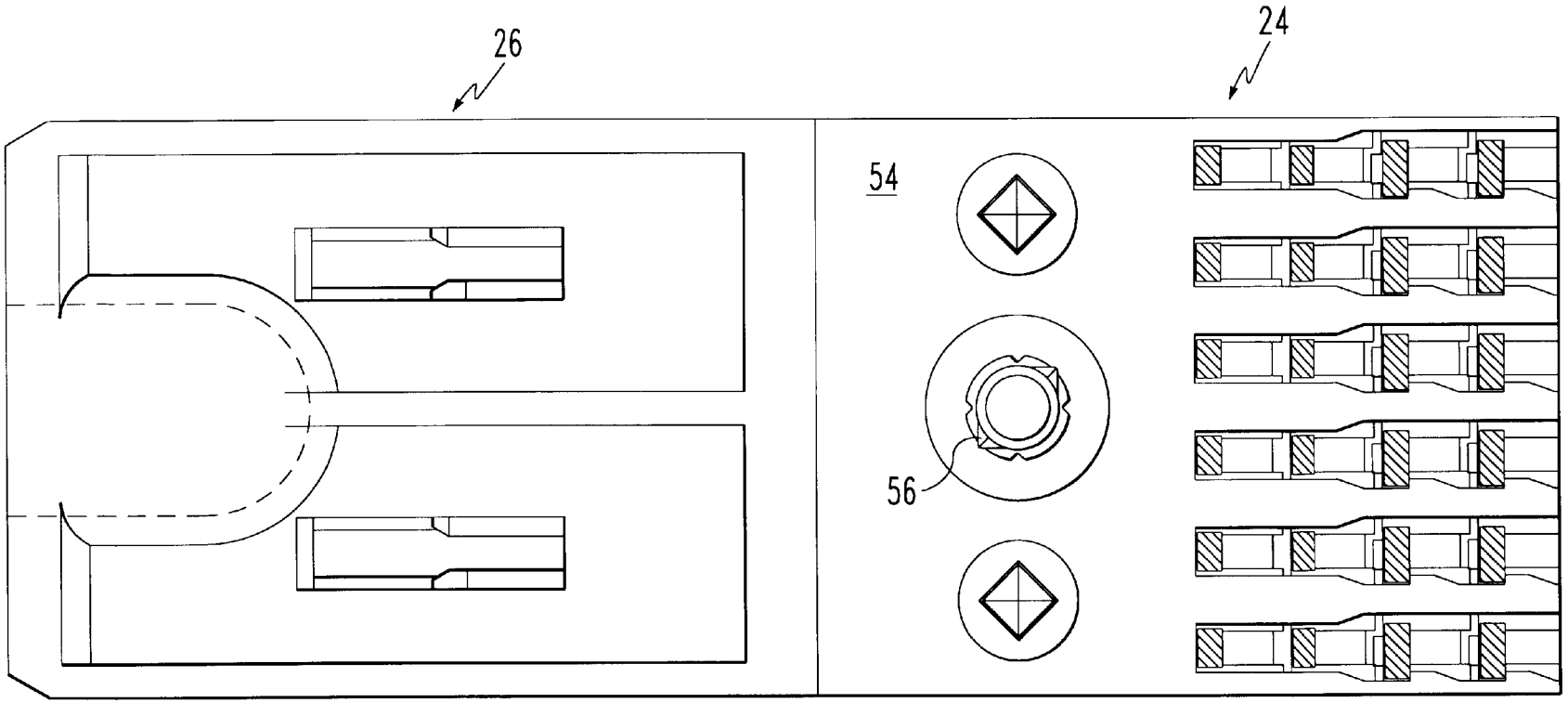
FIG. 3 is a bottom view of the embodiment shown in FIG. 1.
Figure 7:
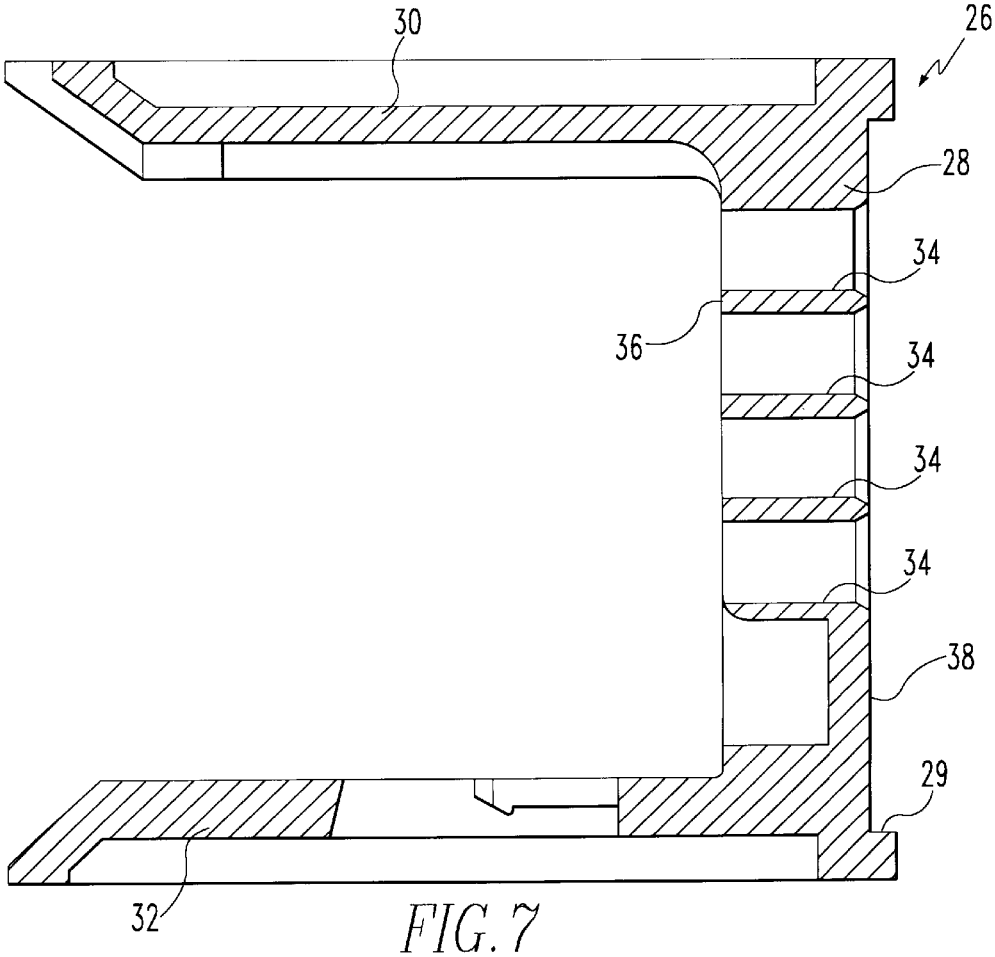
FIG. 7 is a cross-sectional view of a shroud for use with the press block shown in FIG. 5.

Referring to FIGS. 2 and 7, the header 20 comprises two parts that are joined together, a press block 24 and a shroud 26. As shown in FIG. 7, the shroud 26 includes a base portion 28 and top and bottom walls 30 and 32, respectively. The walls 30 and 32 project in a generally perpendicular fashion from base 28 and enclose the pin field on two sides. The base 28 includes a plurality of openings 34 extending from a front or mating interface side 36 to a rear side 38 of the base 28. The openings 34 can be of any desired shape and, as shown, are substantially cylindrical. The shroud 26 can be formed of a molded insulative thermoplastic material or of a conductive material, such as a die cast zinc. An insulative plastic material is chosen when the shroud is not required to perform a shielding function. The shroud 26 can be formed of conductive material, or alternatively a metallized plastic material, when a shielding function is desired.

Figure 5:
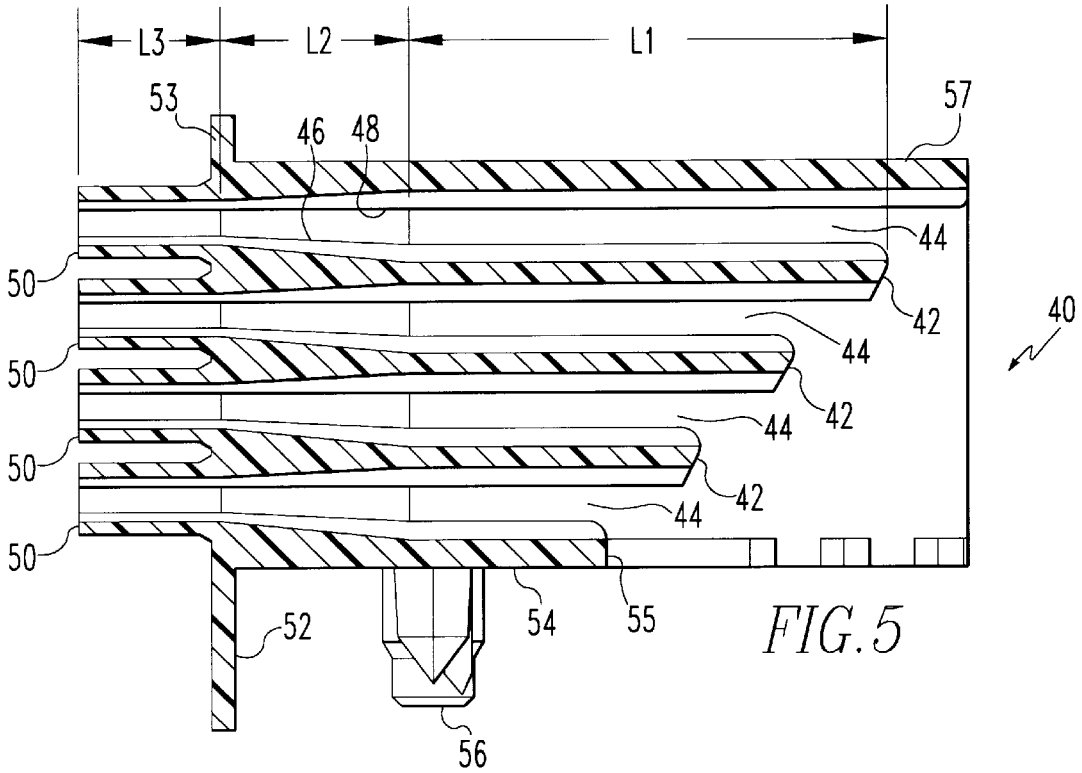
FIG. 5 is a cross-sectional view of a press block prior to insertion of terminal pins.
Figure 5A:
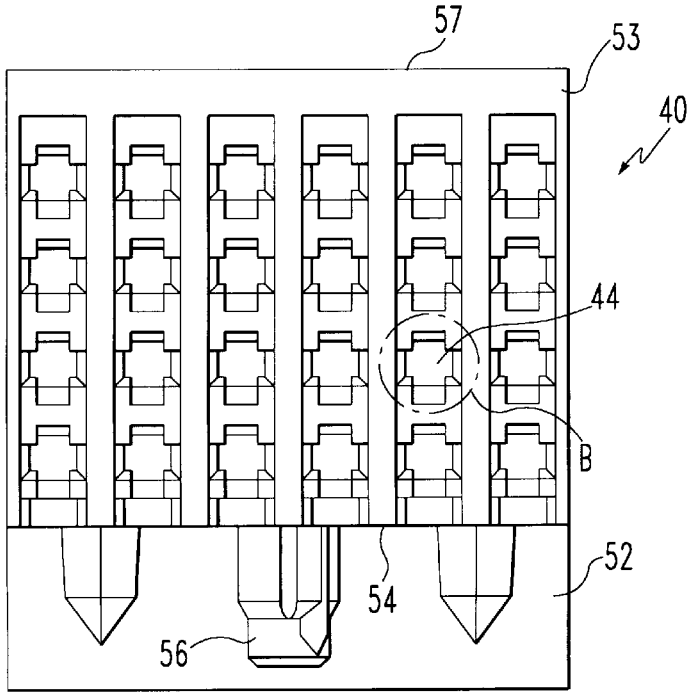
FIG. 5*a* is a rear view of the press block shown in FIG. 5.

As shown in FIGS. 2 and 5, the header 20 also includes a press block or carrier 24 that carries the pin terminals 22*a*–22*d*. The press block 24 comprises a body 40 formed of an insulative material, such as a moldable thermoplastic. The body 40 has a plurality of passages 44 formed therein, corresponding in arrangement to the desired array of pin terminals. As shown in FIGS. 5*a*–5*d*, each passageway 44 has a generally cruciform configuration. The cruciform shape of the passageway 44 provides a lower guide surface 46 (FIG. 5*b*) and an upper guide surface 48 for each of the terminal pins 22. In the portion $L_1$ (FIG. 5) of passage 44, the surfaces are substantially parallel. In the portion of the passageway designated as $L_2$ in FIG. 5, the lower guide surface 46 converges toward the upper guide surface 48. In the front portion $L_3$ of the passageway, the vertical distance between surfaces 46 and 48 is slightly greater than the thickness t of the terminal 22 (FIG. 5*c*).

Figure 5B:
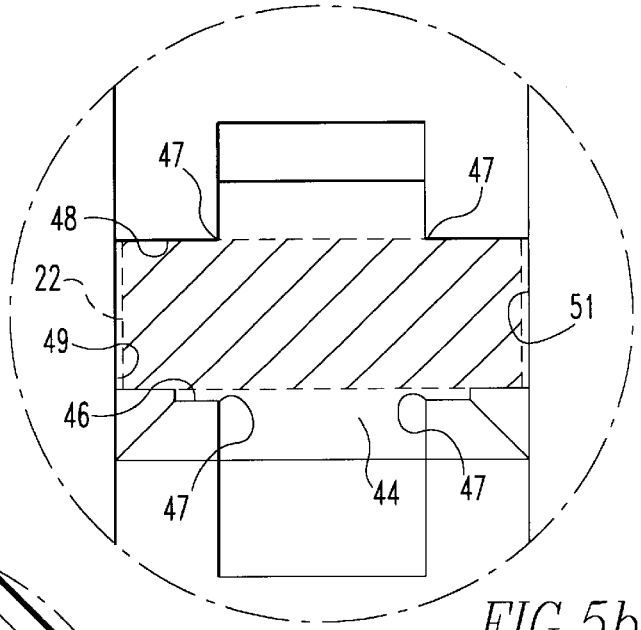
FIG. 5*b* is an enlarged view of the area B of FIG. 5*a* including a sectioned portion of a terminal.
Figure 5C:
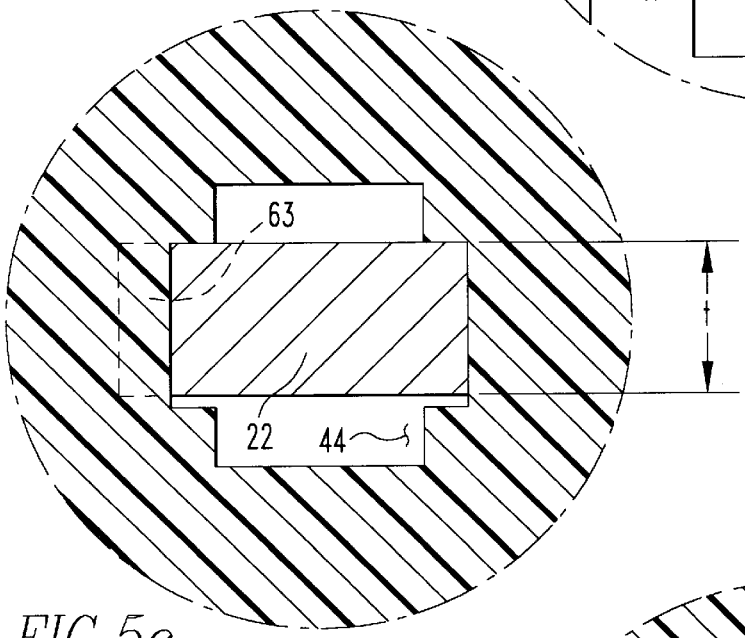
FIG. 5*c* is a cross-sectional view taken in zone $L_3$ of FIG. 5.
Figure 5D:
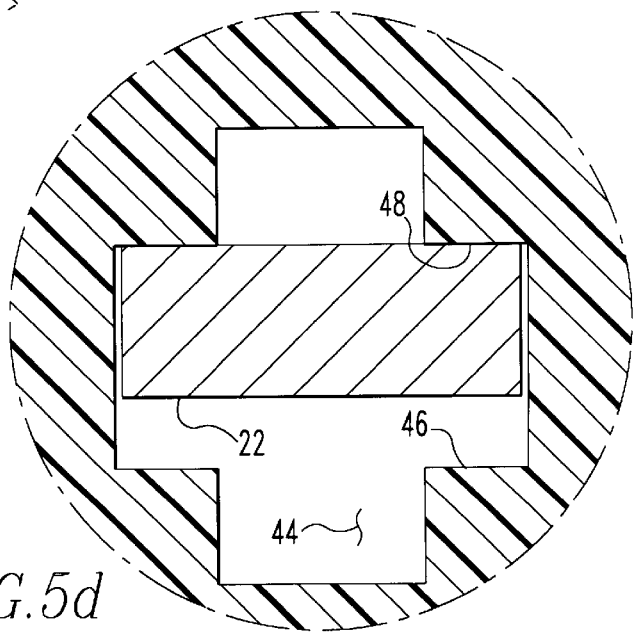
FIG. 5*d* is a cross-sectional view taken in zone $L_1$ of FIG. 5.

FIG. 5*b* is a view looking toward the front end of a passage $L_1$ with a terminal 22 positioned in the passage, from a point just to the left of a bending nick 68. As shown in FIGS. 5*b* and 5*d*, the terminal is positioned against the upper guide surface 48. When an insertion force is applied to the top of the press block, it is distributed to the tail sections of the terminals 22 through the surfaces 48 to push the press fit tails 74 into the circuit board. As shown in FIG. 5*c*, because the vertical height of the passage 44 in zone $L_3$ is just slightly greater than the thickness t of the terminal 22, the vertical position of the pin portion 60 is located with a relatively tight tolerance. Barb 63 is shown in position to lock the terminal against retraction from the passage 44.

The press fit block or carrier 24 includes a plurality of cylindrical bosses 50 that extend beyond the positioning flanges 52, 53. The outer diameter of the bosses 50 and the inner diameter of the openings 34 in the shroud 26 are dimensioned so that there is a substantial interference fit between the bosses and the openings when the press block 24 and shroud 26 are pressed together. This interference fit secures the press block 24 and shroud 26 together. The front surfaces of the flanges 52 and 53 preferably are engaged against the rear side 38 (FIG. 7) of the base wall 28 of shroud 26, to be received within the recess 29.

The press block includes a substantially flat top wall 57, adapted to receive a pressing tool for pressing a finished connector into a printed circuit board. The press block 24 also includes a bottom wall 54, that is adapted to provide the board mounting interface of the connector with the printed circuit board on which the connector is to be mounted. A securing peg 56 depends from the bottom wall 54. The bottom wall 54 also has a plurality of tail receiving grooves 58 (FIG. 6) extending in generally parallel fashion and corresponding in number to the number of columns of the connector. The tail receiving grooves 58 include structures for maintaining lateral and longitudinal positioning of the tails of the terminals, that will be described in greater detail below.

Figure 4:
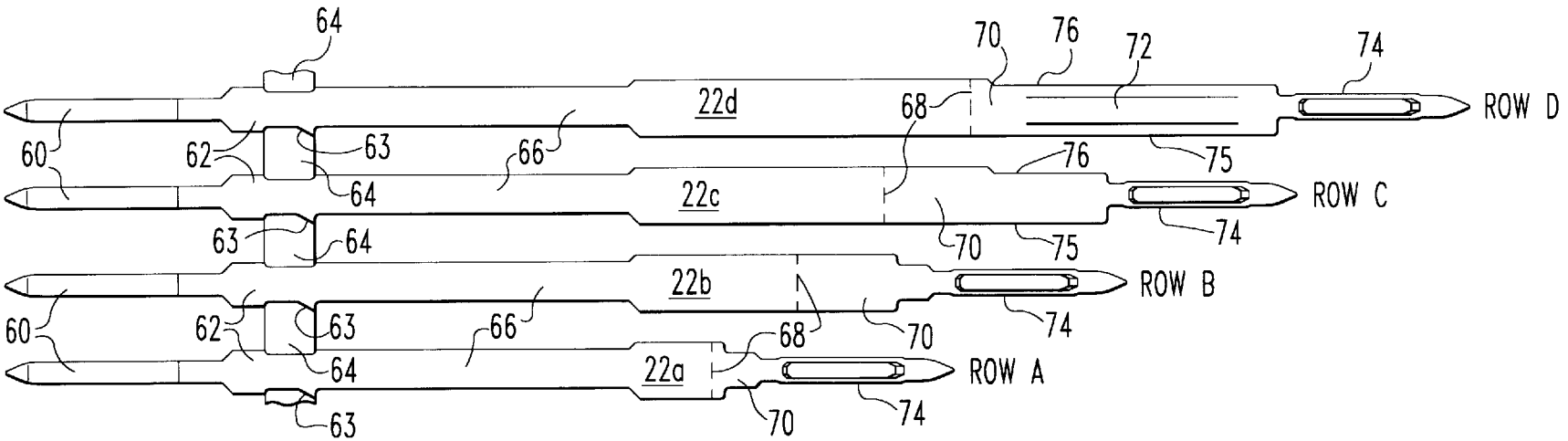
FIG. 4 is a top view of a set of contacts forming one column of terminals of the connector header shown in FIG. 1, in an intermediate stage of manufacture.

Referring to FIG. 4, each set of pin terminals 22*a*, 22*b*, 22*c*, 22*d* are preferably blanked from flat stock, for example, a beryllium copper sheet having a thickness on the order of 0.5 mm. The number of different length pins of each set corresponds to the number of terminal pins in each column of the connector. The shortest pin 22*a* is located on the lowest row of the header and the longest terminal 22*d* is located on the highest row of the header, with the terminals 22*b* and 22*c* being disposed sequentially in the intermediate rows. Each pin terminal 22 includes a contact or mating pin section 60 that is intended to cooperate with a receptacle contact of a mating connector. This section is usually plated to impart corrosion resistance. Each terminal 22 further includes a guide section 62 and locking barbs 63 or shoulders that are formed when the carrier portion 64 is removed to separate the terminals. Each terminal 22 also includes a horizontal tail portion 66, which extends from the retention section 62 to a bending nick 68. The bending nick is intended to promote initiation of bending of the terminal at the location of the nick. Each terminal 22 further includes a vertical tail portion 70 that terminates in a through hole portion, preferably a press fit section 74. If the vertical portion 70 is relatively long, it may be provided with a reinforcing rib 72 formed in the portion 70 to impart additional column strength to resist bending upon insertion.

As shown in FIG. 4, preferably the lowest and next to the lowest row terminals 22*a* and 22*b* respectively have vertical sections 70 that are substantially symmetrical about a longitudinal center line. However, the remainder of the terminals, such as terminals 22*c* and 22*d* have vertical sections that are unsymmetrical, arising from the fact that one edge 75 is substantially straight whereas the opposite edge 76 is relieved along the opposite sides. The purpose of the relief is to allow the tail section 70 to move laterally a small distance, so that it can move past true position stops in the form of abutments or fingers, that are later described.

Figure 8:
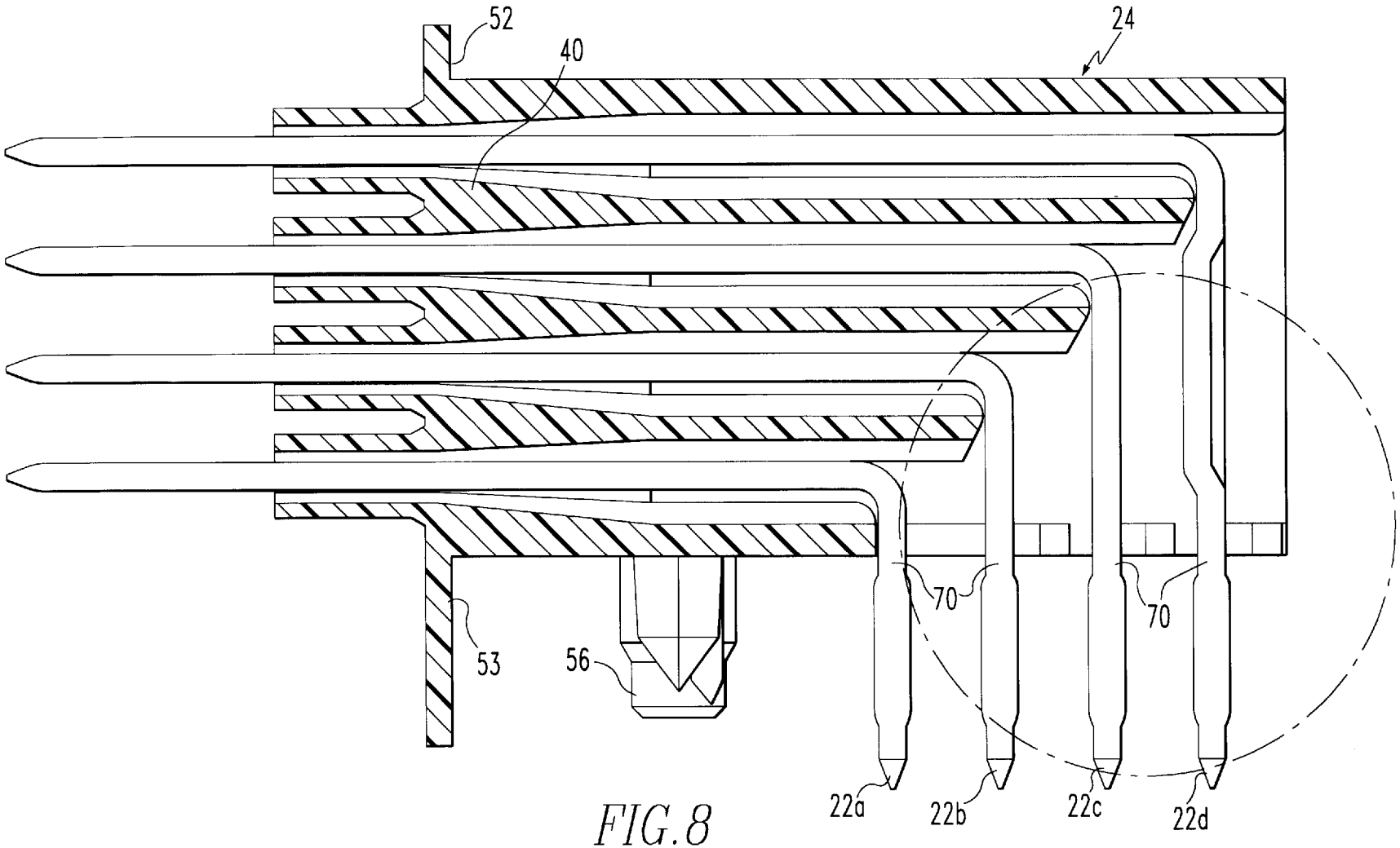
FIG. 8 is a cross-sectional view of the press block as shown in FIG. 5, with pin terminals inserted and bent into final position.

Referring to FIG. 8, a finished, completed press block 24 is shown after insertion of the terminal pins into the plastic body 40. Prior to insertion, the terminals are rotated 90° about their axes from the orientation illustrated in FIG. 4, so that the bending nicks 68 are located substantially horizontally, facing toward the bottom wall 54. The terminals 22*a*–22*d* are inserted longitudinally into the cruciform passages 44 to a position where the retention sections 62 are secured within the bosses 50 and the bending nicks 68 are located in general alignment with the shorter wall 42 of each of the passageways 44. As each terminal is inserted along each passageway, 44, its movement in the vertical direction is constrained by the upper and lower walls 46 and 48 and in the lateral direction by the side walls 49 and 51 (FIG. 5*b*). As the retention portion 62 enters the zone $L_2$ of the passageway the walls 46 or 48 help to position the terminal 22 in its final vertical position within each boss 50 as illustrated by the phantom position of terminal 22 shown in FIG. 5*c*. The barb 63 snags a side wall of the passage and prevents the terminal from moving rearwardly out of the passage. Preferably the terminals 22 are stitched into body 40 row by row, beginning at the lowermost row. The shroud 26 can be assembled to the press block body 40 before or after terminal stitching. The use of the cruciform passageway 22 minimizes damage to plating on the contact section 60 of the pin as the terminal is inserted into the press block body 40. This results from the fact that only the interior corners 47 are likely to be engaged by the section 60 as the terminal is inserted. Although, the cruciform shape has been found effective and relatively easy to incorporate into tooling, any shape that provides opposed narrow projections projecting inwardly toward the center of the passage is believed to be useful for this purpose.

Figure 6:
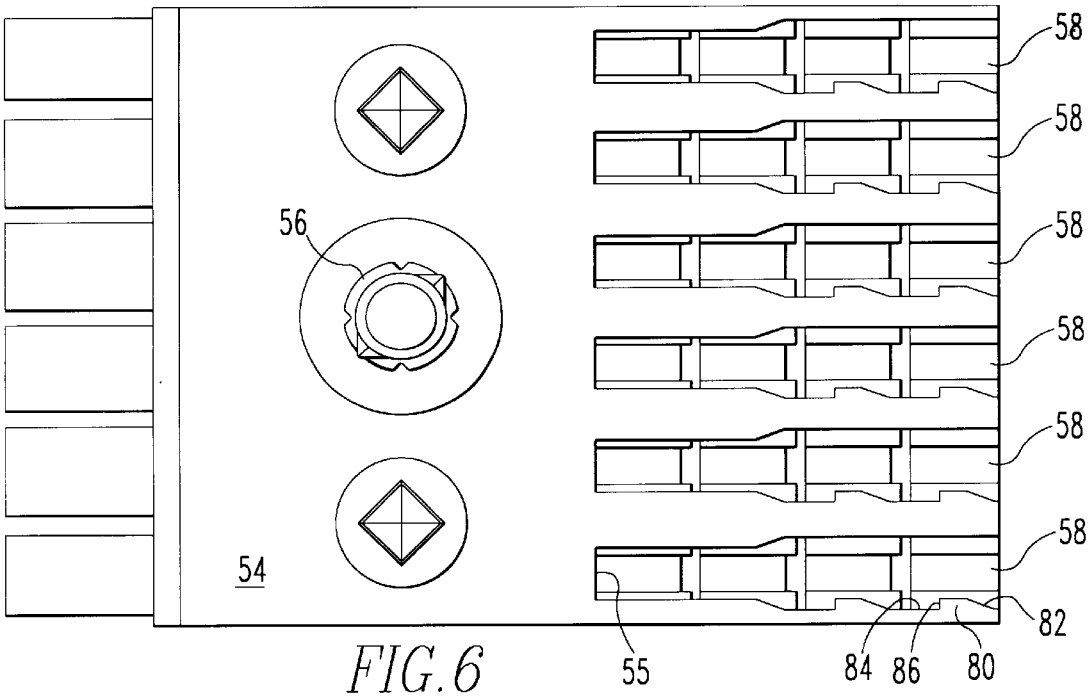
FIG. 6 is a bottom view of the press block shown in FIG. 5.
Figure 8A:
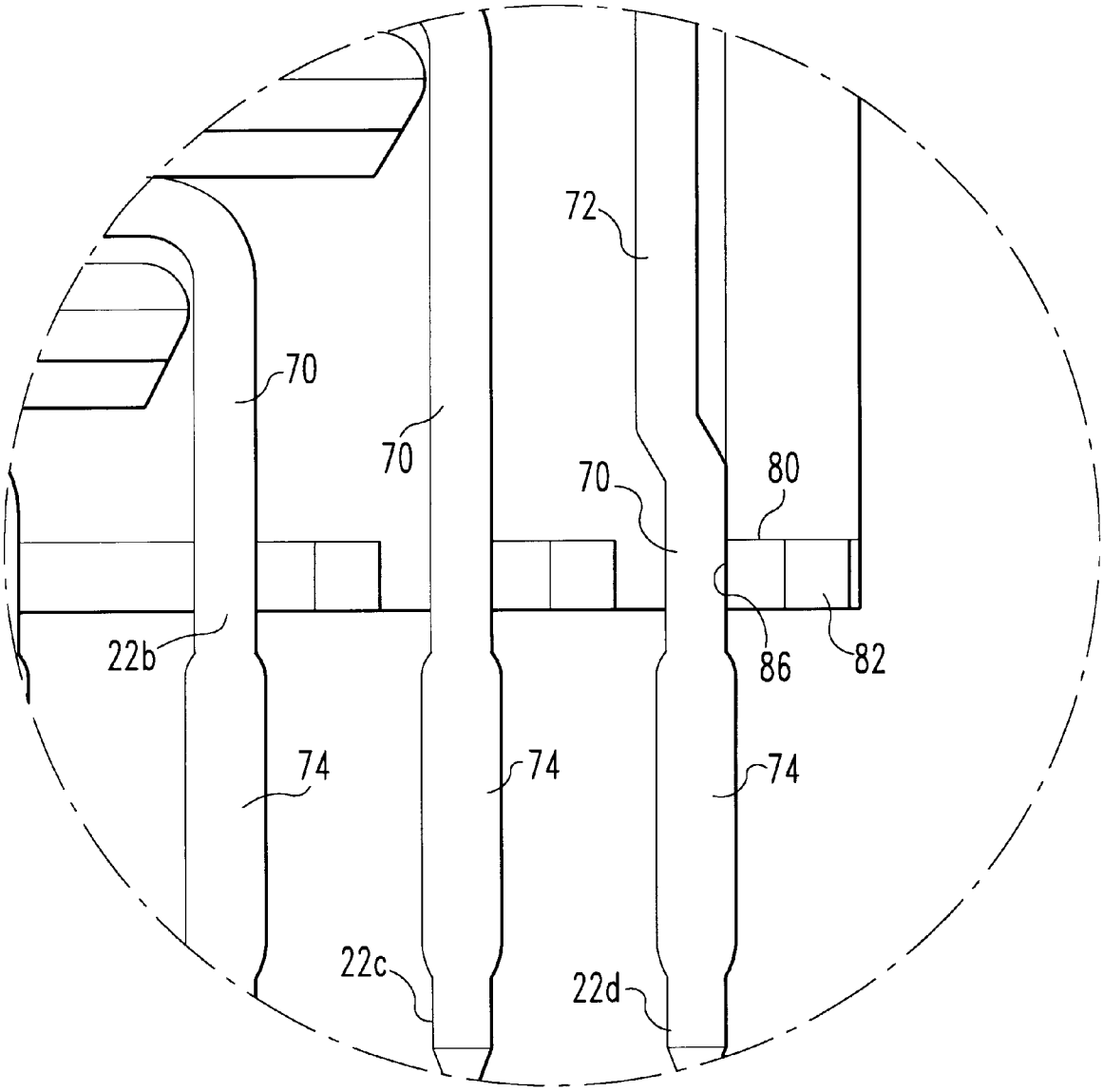
FIG. 8*a* is an enlarged view of the circled area C of FIG. 8.
Figure 9:
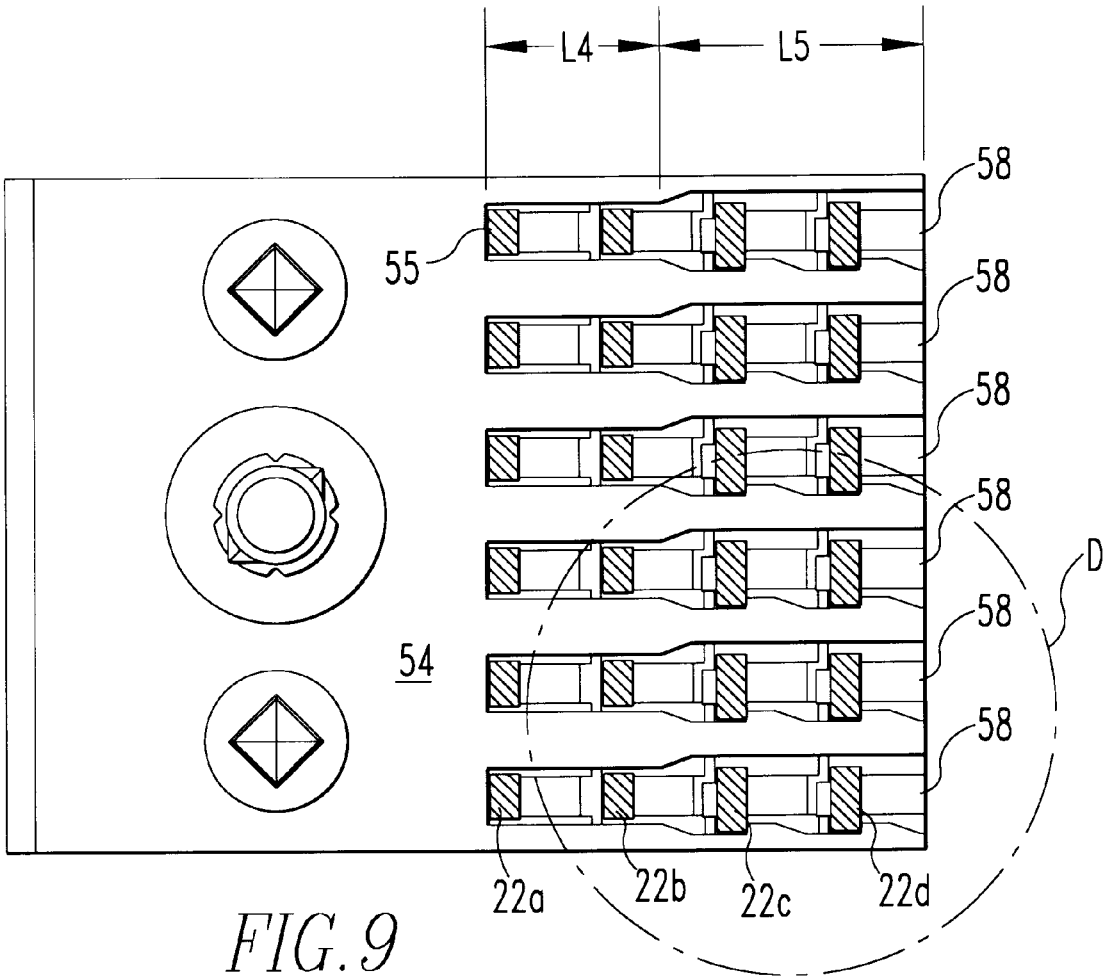
FIG. 9 is a bottom view of the press block with terminals shown in FIG. 8.
Figure 9A:
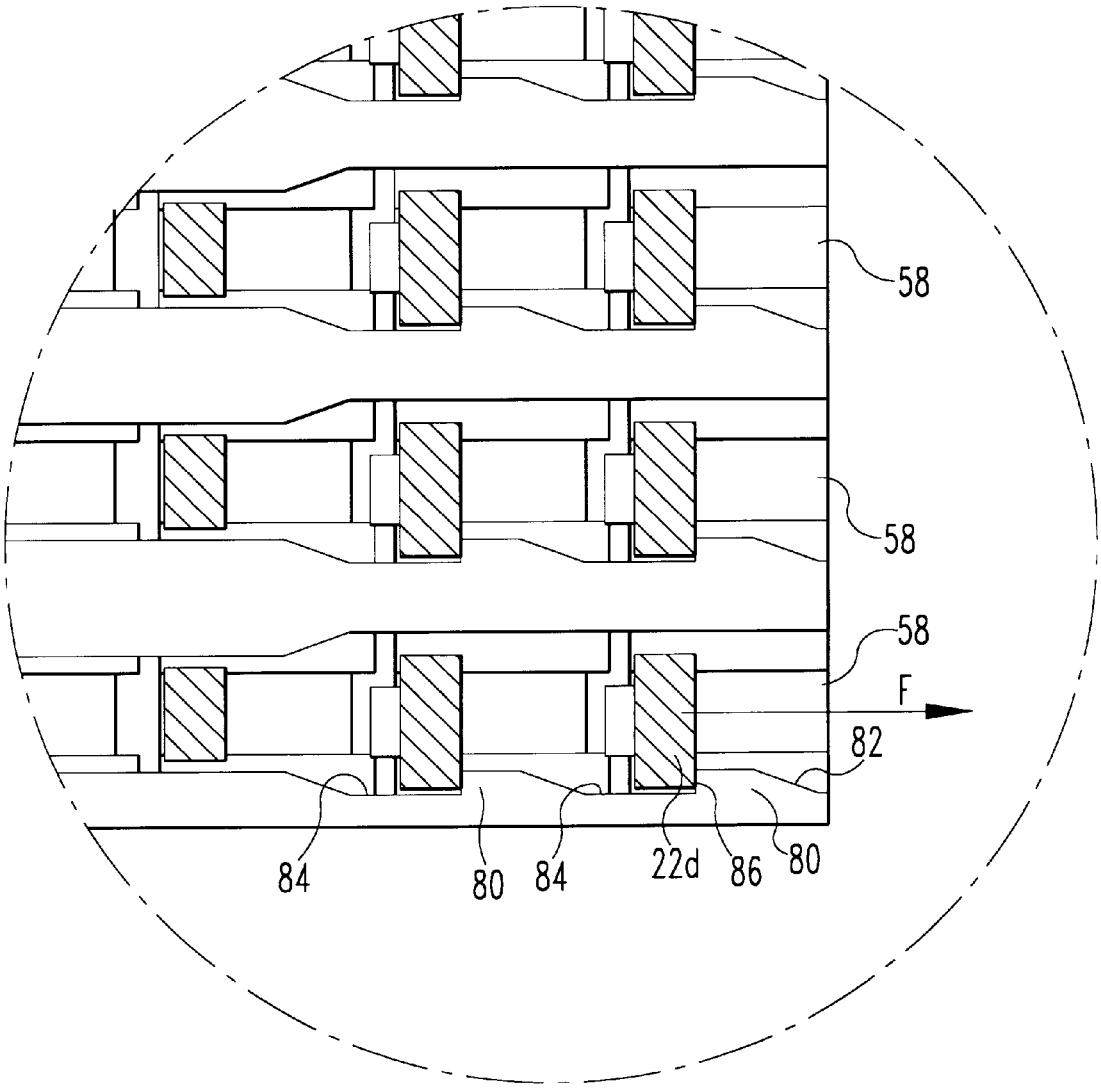
FIG. 9*a* is an enlarged view of the area D of FIG. 9.

After insertion of the terminals 22 into the block 40, each terminal is bent by appropriate tooling to form the vertical sections 70. As the terminals are bent about the bending nicks 68 toward a vertical orientation, the vertical tail portions enter the tail slots or grooves 58 (FIG. 6). For the lowest row terminals 22*a*, the lateral or side to side positioning of the press fit tail section is derived by the close relationship between the side edges of the fore portions $L_4$ of the tail grooves 58 engaging the side edges of the terminal. Longitudinal or end to end positioning is achieved by positioning the tail against the end 55 of the slot. For subsequent terminals in each column, the true location features are somewhat different. When the vertical sections of these terminals are formed by bending, the bottom portions adjacent the press fit sections 74 enter into the tail slots 58. The bent tails of the terminals 22*b*, 22*c* and 22*d* are located in the section $L_5$ of the groove. In the section $L_5$ (FIG. 9) of each groove there is disposed a true position locating feature for retaining the press fit tails 74 in proper longitudinal location. As illustrated in FIGS. 8*a* and 9*a*, a preferred form of true location positioning structure comprises a series of abutments formed adjacent a succession of recesses 84 in the side wall of the slot 58. At the junction between each recess 84 and each abutment 80, a shoulder 86 is formed. Each abutment ideally includes a ramp section 82 that facilitates movement of the tail past the abutment. As the tail section of each terminal is bent, it enters an associated tail slot 58 and, depending upon its row location, engages one or more of the abutments 80 as it is bent. As previously described, the relieved areas or edges 76 on the vertical tails 70 allow the tails to move laterally in the slot 58 as the straight edges 75 encounter the abutments 80. The tails are bent to a degree such that there is a residual amount of pretension in each tail that tends to bias the tail in the direction of arrow F (FIG. 9*a*). As a result, when the tooling for bending is withdrawn, each terminal tail section 70 has an inherent spring bias in the direction of arrow F. As a result, each tail section moves rearwardly and engages shoulder 86 of an associated abutment 80. This provides longitudinal positioning for each of the tail sections. Lateral positioning is assured by having the edge 75 or each tail section located adjacent or slightly biased in torsion, against the recess 84.

Figure 10:
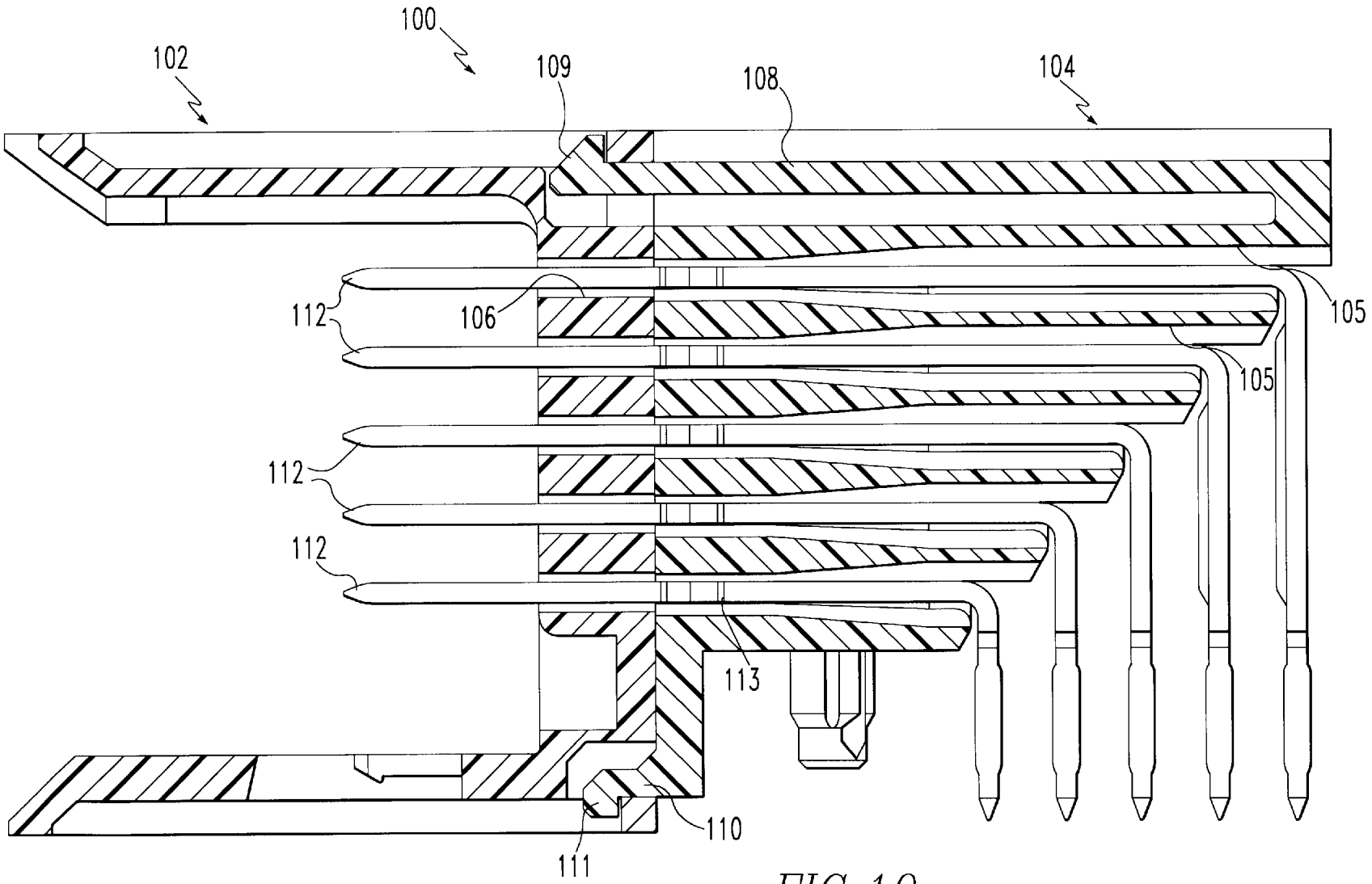
FIG. 10 is a cross-section of a second embodiment, wherein the shroud is latched onto the press block.

FIG. 10 shows a second embodiment of right angle press fit connector header 100 formed of two separate elements, a shroud 102 and a press block 104. In this embodiment, the press block 104 includes one or more elongated upper latch arms 108 and one or more lower latch members 110. The latches 109 and 111 of latch arms 108 and 110, respectively are received in suitably configured openings in the base of the shroud 102 to secure the shroud 102 and press block 104 together. The press block 104 is formed of insulative material, preferably a molded plastic. The terminals 112 are press fit into the block 104. In this embodiment, the retention barbs 113 lock into the side walls of the passageway in the front portions of the passages 105. If the header 100 is of a non-shielding type, the shroud 102 is formed of an insulative material, again preferably a molded plastic. In this case, the terminals 112 merely extend through openings 106 in the shroud. If the header 110 is to comprise a shielded header, then shroud 102 can be formed of a conductive material, such as a die cast metal or a metallized plastic. In this instance, it is preferable to included bosses (not shown) integrally formed on the press block 104, similar to bosses 50 of the first embodiment, for electrically insulating each of the terminals on 112 from the shroud.

Figure 11:
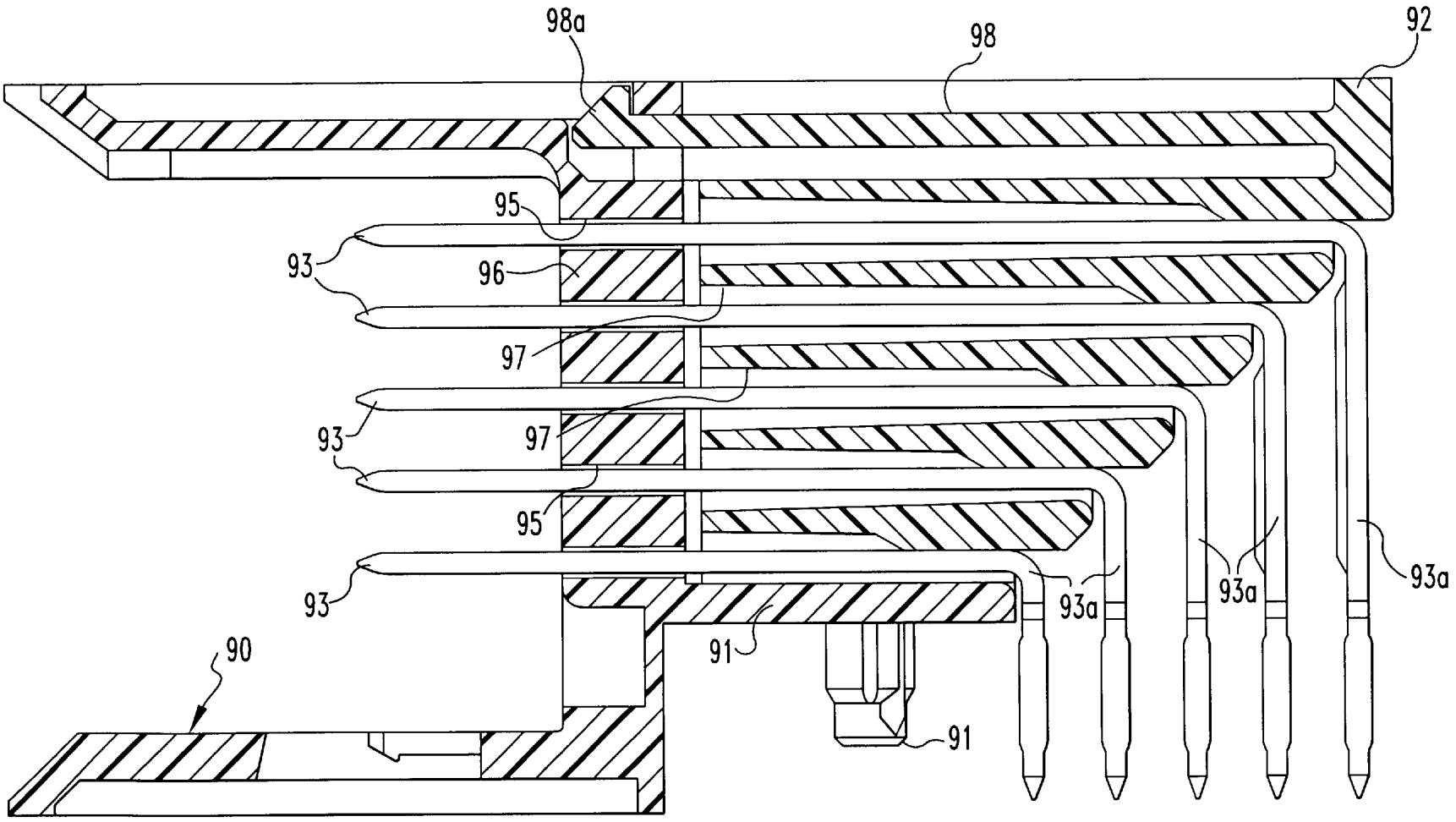
FIG. 11 is a cross-sectional view of a third embodiment, wherein the board mounting section is integral with the shroud.

FIG. 11 illustrates a third embodiment of connector that has a shroud 90 and press block 92. The shroud includes a circuit board mounting wall 91 that, preferably, is molded integrally with the shroud. The wall 91 includes hold down/location peg 94 for locating and holding the connector on a printed circuit board. In this embodiment, the pin terminals 93 are retained in the shroud 90 by retention within openings 95 in the base 96 of shroud 90. After the pin terminals 93 are press fitted into the base 96 and while they are still straight, the press block 92 is slid onto the terminals, with the tail sections of the terminals received in passages 97. One or more latch arms 98 are preferably integrally molded with press block 92 and carry a latch portion 98*a* that engages suitable openings in shroud 90 to secure the press block to the shroud. Thereafter, the vertical tails 93a of the terminals are bent.

Figure 12:
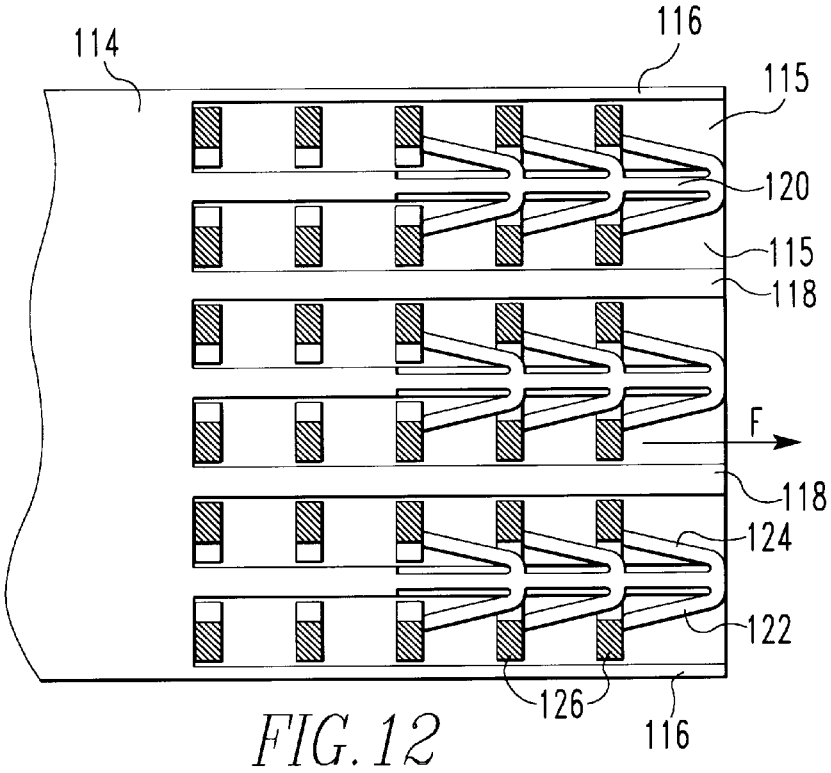
FIGS. 12 and 12*a* are bottom views of a press block section showing other types of terminal tail positioning structures.
Figure 12A:
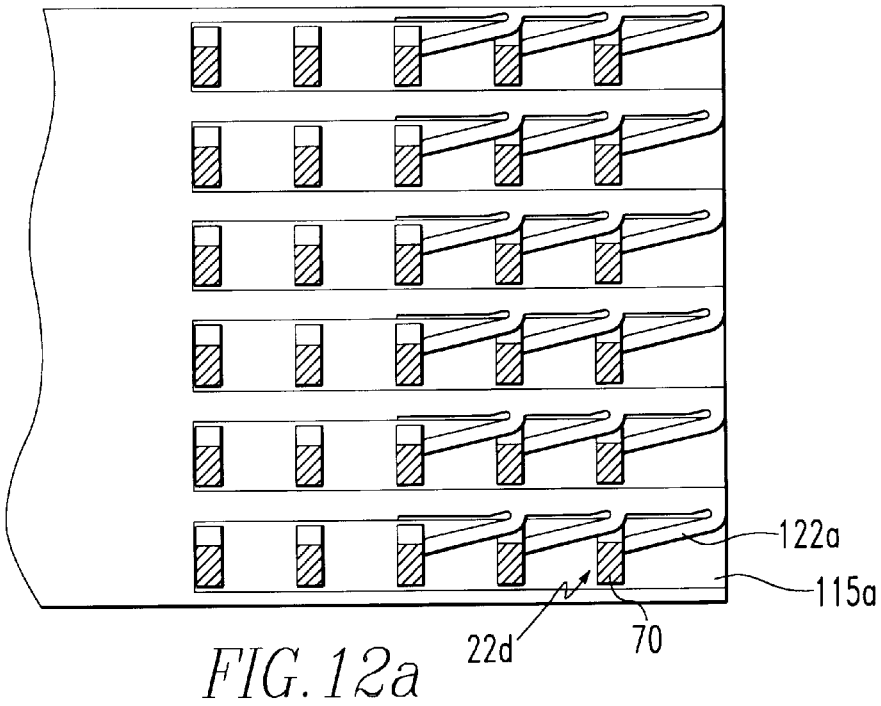

Referring to FIG. 12, in a view similar to FIG. 6, there is shown a second type of structure for fixing the true position of the press fit tail sections of the terminals. The structure shown in FIG. 12 is meant to accomplish substantially the same true position function as the arrangement shown in FIGS. 8*a* and 9*a*. In the arrangement shown in FIG. 12, the bottom surface 114 of the press block includes a number of tail receiving slots 115 corresponding to the number of columns of terminals in the connector. The tail receiving slots 115 are formed between alternating stop walls 120 and either outside walls 116 or intermediate walls 118. The stop walls 120 are formed with a plurality of successive flexible fingers 122 and 124. As each terminal tail section is bent to a vertical position, it engages one or more of the flexible fingers 122, 124 and urges them to a deflected position as the terminal passes. Once the terminal tail 126 passes by a resilient finger, the finger resiles toward the opposite side of the groove. As previously noted in connection with the first embodiment, each terminal tail is bent to a degree so that it retains a certain pretension in the direction of the arrow F. As a consequence, when the vertical tail 126 of a particular terminal passes the stop finger 122, 124 closest to its final position, the finger moves toward an opposite wall of the groove 115 and is positioned so that its end surface engages the terminal 126 against its inherent spring bias, thereby providing longitudinal location for the press fit section. As shown in FIG. 12, lateral positioning of the terminal tails is achieved by having one edge thereof engaging the surface of one of the walls 116, 118. Alternatively, arrays of fingers 122*a* can be disposed on one side of each of the slots 115*a*, as shown in FIG. 12*a*. This arrangement has the advantages of being somewhat easier to tool than the FIG. 12 embodiment and also allows the use of terminals that are completely symmetrical, even in the tail sections.

The foregoing embodiments yield manufacturing cost advantages arising from the fact that a single terminal bearing carrier or plus press block may be associated with a plurality of different types of shrouds to form a multiplicity of different header configurations. This simplifies tooling requirements and ultimately results in lower costs.

True positioning of the press fit tails of the right angle connector is achieved by incorporating the locating structure integrally into the terminal carrying press block. The tail true position location can be used for pin headers, as shown, but also with any type of terminal having a bent tail that must be positioned for circuit board insertion. The use of cruciform shaped terminal receiving passages results in improved protection of plating on the terminals and yields a relatively rigid press block structure.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

a shroud having:

a base having a plurality of openings; and at least one wall extending from the base;

a press block body formed of an electrically insulative material and comprising:

a surface for receiving a press tool, a front section, a rear section;

an array of terminal receiving passages, each passage extending from the front section to the rear section, and a plurality of bosses;

a plurality of conductive terminals mounted on the press block body, each terminal having:

longitudinally extending axial portion received in one of said array of passages and in one of the bosses; and a tail portion disposed at an angle to the axial portion and having a press fit section disposed at an end of the tail portion;

wherein each passageway has an upper surface arranged to impart a pressing force on said axially extending portion of the terminal received in the passageway, whereby a pressing force applied to the tool receiving surface is imparted to the tail portion of each terminal; and wherein the bosses are received in the openings for securing the shroud onto the press block body.

2. A connector as in claim 1, wherein the bosses are secured in the openings with an interference fit.

3. A connector as in claim 1, wherein the upper surface of each passage comprises a pair of surfaces spaced transversely from each other and located to engage edge surfaces of said axial portion of a terminal received in the passage.

4. A connector as in claim 1, wherein each passage has a lower surface and the upper surface and the lower surface of each passageway converge from the rear section to the front section of the body.

5. A connector as in claim 1, wherein each passage includes narrow portions projecting inwardly toward a longitudinal axis.

6. A connector as in claim 1, wherein each passage has a substantially cruciform shape in cross section.

7. A connector as in claim 1, wherein the press block body includes tail retention structure for positioning said press fit sections of the terminal tails.

8. A connector as in claim 1, wherein each passage has a bottom wall and, at the rear section of the body, the top wall of each passage extends beyond the bottom wall of each passage.

9. A connector as in claim 8, wherein each terminal includes bend enhancing structure and the bend enhancing structure is positioned adjacent the rear end of the bottom wall of each passage.

10. A connector as in claim 1, wherein the press block body comprises a face adjacent said front, and the base of the shroud is positioned along said face and portions of the conductive terminals extend through said base.

11. A connector as in claim 10, wherein the press block body includes a securing element for securing said shroud on said face.

12. A printed circuit board-mounted electrical connect comprising, an insulative body having a front section and a rear section;

a plurality of terminal receiving passages in the body extending from the front section to the rear section, each passage having a substantially cruciform shape in cross-section, an upper wall and a lower wall, the upper wall of each passage extending beyond the lower wall at the rear portion of the body;

a plurality of conductive terminals mounted on the body, each terminal having a longitudinally extending axial portion received in one of the passages and a tail portion extending transversely of the axial portion at the rear section of the body; each terminal having a notch located adjacent a rear end of the lower surface of the passage in which the terminal is received for enhancing the bending of the terminal, and each terminal having a press fit section disposed at a distal end of the tail portion for mounting to the printed circuit board; and a positioning structure for positioning said press fit sections of the terminals relative to the body.

13. A connector as in claim 12, wherein each passage includes a plurality of spaced portions extending toward a longitudinal axis of the passage and forming parts of the upper and lower walls of the passage.

14. A connector as in claim 12, wherein the lower wall converges toward the upper wall, proceeding from the rear section toward the front section.

15. A connector as in claim 12, wherein the notch is a nick.

16. A connector as in claim 12, wherein the notch extends across the terminal.

17. An electrical connector comprising, an insulative body having a front section and a rear section;

a plurality of terminal receiving passages in the body extending from the front section to the rear section, each passage having an upper wall and a lower wall, the lower wall converging toward the upper wall from the rear section towards the front section, the upper wall of each passage extending beyond the lower wall at the rear portion of the body;

a plurality of conductive terminals mounted on the body, each terminal having a longitudinally extending axial portion received in one of the passages and a tail portion extending transversely of the axial portion at the rear section of the body; each terminal having a bend enhancing feature located adjacent a rear end of the lower surface of the passage in which the terminal is received, and each terminal having a press fit section disposed at a distal end of the tail portion; and a positioning structure for positioning said press fit sections of the terminals relative to the body.

18. A connector as in claim 17, wherein each passage has a substantially cruciform shape in cross-section.

* * * * *